US007040211B1

(12) United States Patent
Bennett et al.

(10) Patent No.: US 7,040,211 B1
(45) Date of Patent: May 9, 2006

(54) MORTAR BOMB RETENTION APPARATUS

(75) Inventors: Leon J. Bennett, Voorheesville, NY (US); Donald G. Forkas, Rexford, NY (US); George E. Hathaway, IV, Sprakers, NY (US); Ronald G. Gast, Cohoes, NY (US); Ronald S. Jacobs, Malta, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/907,574

(22) Filed: Apr. 6, 2005

(51) Int. Cl.
*B64D 1/04* (2006.01)

(52) U.S. Cl. ..... 89/1.35; 89/37.05; 89/40.02; 89/27.11

(58) Field of Classification Search ..... 89/1.35, 89/37.05, 40.02, 14.05, 27.11, 33.01
See application file for complete search history.

(56) References Cited

U.S. PATENT DOCUMENTS 1,827,031 A * 10/1931 McBride ..... 89/1.35
4,660,458 A * 4/1987 von Laar et al. ..... 89/25
5,677,507 A * 10/1997 Becker et al. ..... 89/47
6,095,026 A * 8/2000 Poussard et al. ..... 89/46
6,912,945 B1 * 7/2005 Ang ..... 89/37.05
2005/0022659 A1 * 2/2005 Domeij ..... 89/45

* cited by examiner

*Primary Examiner*—J. Woodrow Eldred
(74) *Attorney, Agent, or Firm*—Robert Charles Beam; John F. Moran

(57) ABSTRACT

A mortar bomb retention apparatus for retaining a mortar bomb in a mortar tube includes a lever arm; a lever positioner in which the lever arm is rotatably mounted; a generally cylindrical housing having a central opening therethrough, the central opening comprising a large diameter portion and a small diameter portion, the lever positioner being fixed to the housing; a shoe disposed in the central opening in the housing; a compression spring disposed around the shoe in the large diameter portion of the central opening; and a shoe cap attached to an end of the shoe, one end of the compression spring bearing against the shoe cap, a portion of the lever arm contacting the shoe cap wherein rotation of the lever arm is operable to force the shoe downward.

13 Claims, 7 Drawing Sheets

MORTAR BOMB RETENTION APPARATUS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar munitions and in particular to breech loaded mortar munitions.

In the past, mortars have been muzzle loaded. With muzzle loaded mortars, the position of the mortar bomb in the mortar tube is not an issue. For a breech loaded mortar to work, particularly when the mortar tube is in an elevated position (i.e., not horizontal), a device is needed to hold the mortar bomb at a distance from the breech while the breech is being closed. Prior to the present invention, there has not been such a device.

A primary object of the invention is to enable a breech loaded mortar bomb to be held in a mortar tube at a distance from the breech while the breech is being closed, at any and all elevations of the mortar tube muzzle.

Another object of the invention is to provide an apparatus that prevents a breech loaded mortar bomb that is loaded at zero elevation (i.e., the mortar tube is horizontal) from being thrown down the mortar tube out of firing position by an auto loader or operating personnel.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
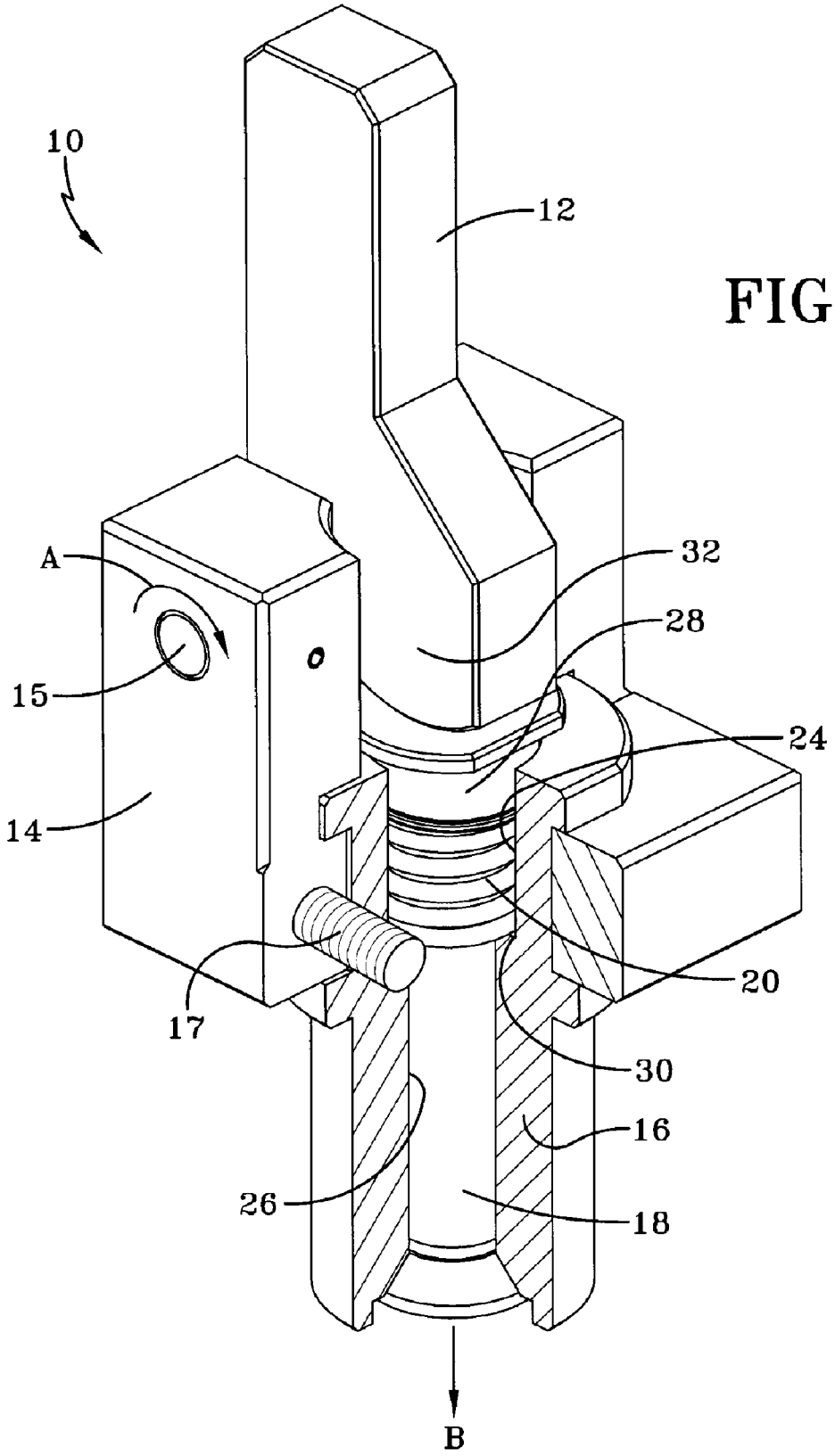
FIG. 1 is a cutaway perspective view of an embodiment of a mortar bomb retention apparatus.

FIG. 1 is a cutaway perspective view of an embodiment of a mortar bomb retention apparatus 10 according to the invention. The apparatus 10 includes a lever arm 12 and a lever positioner 14 in which the lever arm 12 is rotatably mounted using, for example, pin 15. A generally cylindrical housing 16 has a central opening therethrough. The central opening comprises a large diameter upper portion 24 and a small diameter lower portion 26. The lever positioner 14 is fixed around housing 16 using screws 17. A shoe 18 is disposed in the central opening in the housing 16. A compression spring 20 is disposed around the shoe 18 in the large diameter portion 24 of the central opening. A shoe cap 28 is attached to the upper end of the shoe 18.

The central opening 22 includes a step 30 located between the large and small diameter portions 24, 26. One end of the compression spring 20 bears against the step 30 and another end of the compression spring 20 bears against shoe cap 28. A lower portion 32 of the lever arm 12 is in contact with the shoe cap 28. FIG. 1 shows lever arm 12 in the upright position and shoe 18 in the retracted position inside housing 16. When the lever arm 12 is rotated in the direction shown by arrow A in FIG. 1, the shoe 18 moves downward as shown by arrow B. When the force moving lever arm 12 is removed, compression spring 20 moves lever 12 back to its upright position and shoe 18 is retracted back into housing 16.

Figure 2:
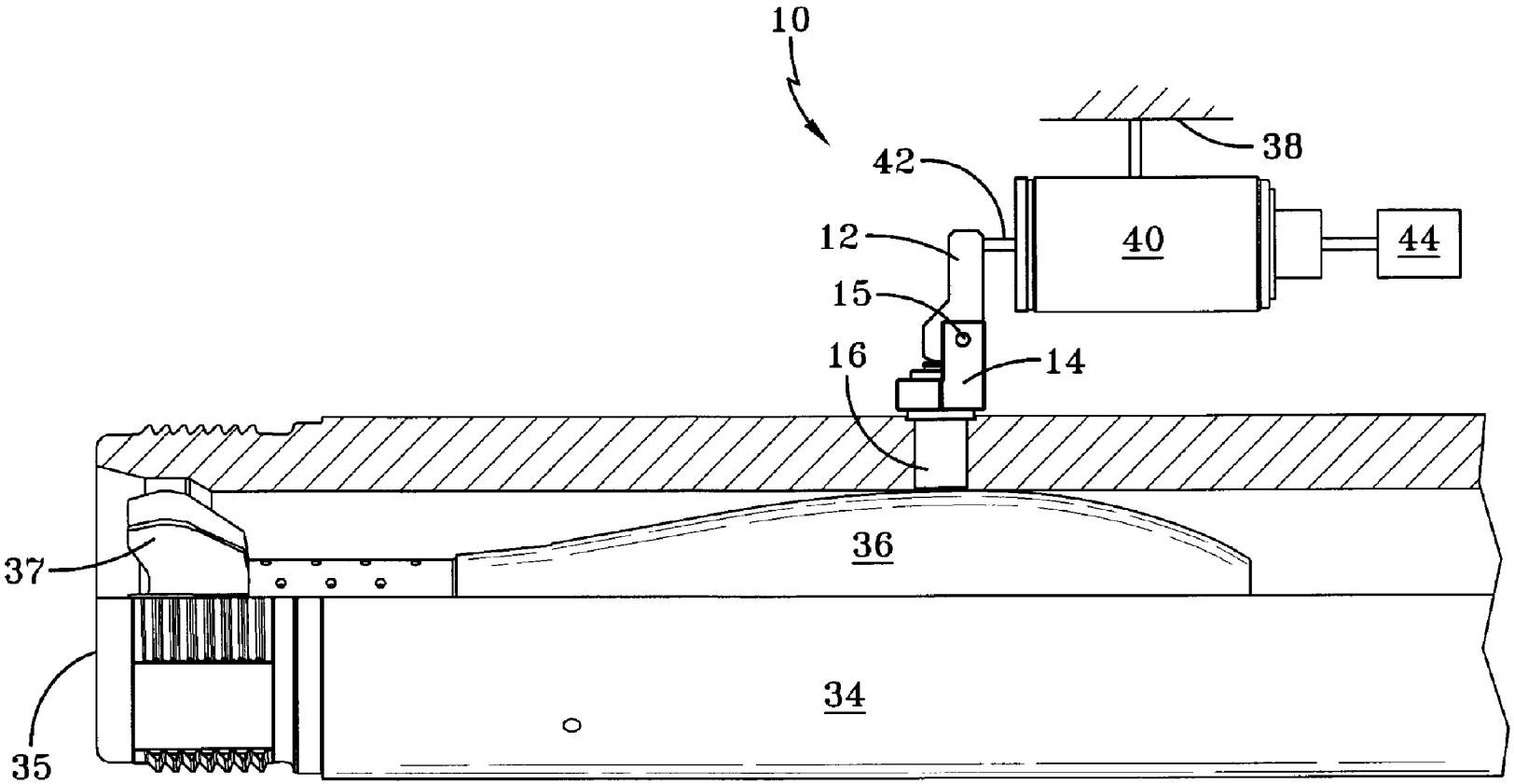
FIG. 2 is a cutaway side view, partially in section, of a mortar bomb retention apparatus incorporated with a mortar munition.

FIG. 2 is a cutaway side view, partially in section, of a mortar bomb retention apparatus 10 incorporated with a mortar munition. The mortar munition includes a mortar tube 34, a mortar bomb 36 and a recoilless surface 38. Mortar tube 34 has a breech end 35 through which mortar bomb 36 is loaded into mortar tube 34. Mortar bomb 36 has a tail end 37 typically having fins. Recoilless surface 38 may be any non-recoiling surface within the munition, such as a bracket or bulkhead. Of course, the surface 38 must be in the proper position to locate solenoid 40.

Solenoid 40 includes a plunger 42 that contacts lever arm 12 and is operable to rotate lever arm 12. In FIG. 2, rotation of lever arm 12 is counter clockwise around pin 15. Lever arm 12 typically rotates, for example, twenty degrees. Mortar tube 34 includes an opening in its wall into which housing 16 is disposed. Housing 16 may be provided with external threads that engage internal threads in the opening in the wall of tube 34. Housing 16 is mounted so that the end of the housing is flush with the interior surface of tube 34. Solenoid 40 is electrically connected to fire control computer 44.

The invention operates in two primary modes, depending on the elevation of the mortar tube 34. One mode of operation is with the mortar tube 34 horizontal (zero elevation) and the other mode of operation is with the mortar tube 34 elevated. With the mortar tube at zero elevation, a breech loaded mortar bomb 36 may "thrown down" the tube 34, out of firing position, by an auto loader or operating personnel. To prevent this, the fire control computer 44 operates the solenoid 40 in a "pulse" mode. In the pulse mode, the fire control computer 44 sends a rapid series of on and off signals to solenoid 40 that causes the shoe 18 to alternately extend into and retract from the mortar tube 34. The alternating contact with the shoe 18 slows down the travel of the breech loaded mortar bomb 36 and prevents it from traveling out of firing position. Prior to firing the mortar bomb, the pulse mode is disabled and the shoe 18 is completely retracted from the tube 34.

When the mortar tube is used in an elevated position, it is necessary to hold the mortar bomb in the tube away from the breech while the breech is being closed. With the mortar tube 34 elevated, the bomb 36 is breech loaded (The shoe 18 is in the inactive, retracted position.) to a point in the tube forward of the firing position. Once the bomb 36 is in that position, the computer 44 activates the shoe 18, thereby holding the bomb 36 in place. The breech is then able to close without the bomb 36 falling back out of the breech. Once the breech is closed, the shoe 18 is retracted and gravity allows the bomb 36 to fall against the breech into the firing position.

Figure 3:
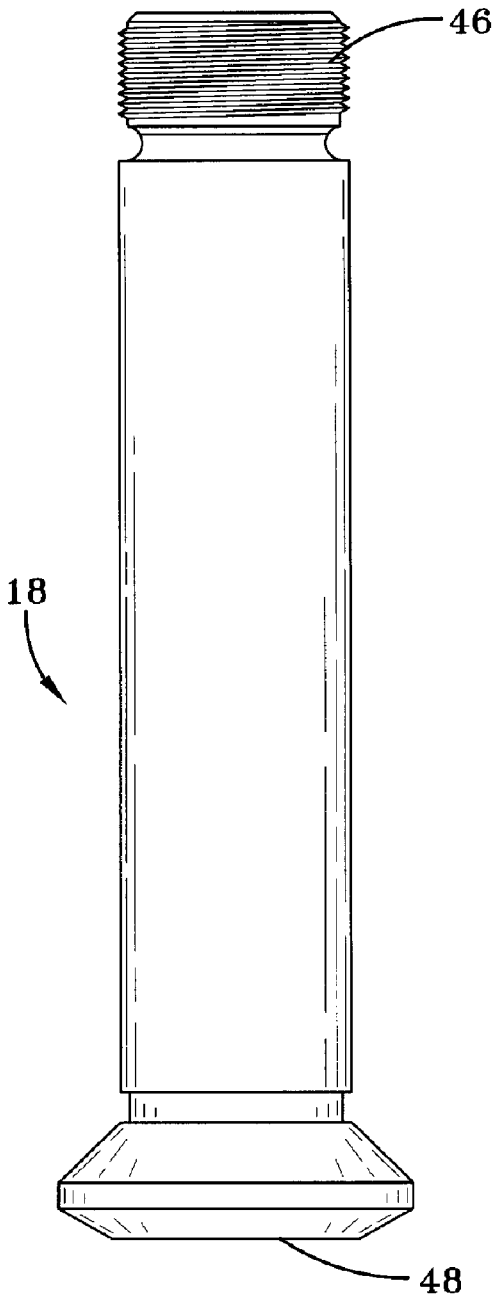
FIG. 3 is a side view of a shoe.
Figure 4:
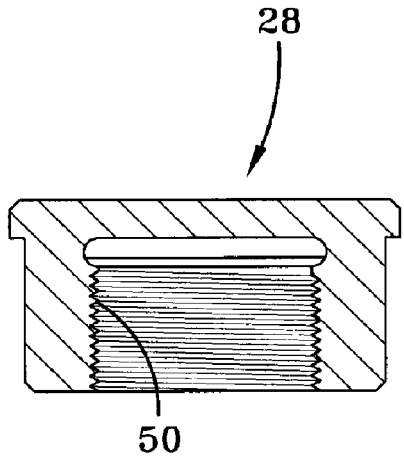
FIG. 4 is a sectional side view of a shoe cap.
Figure 6:
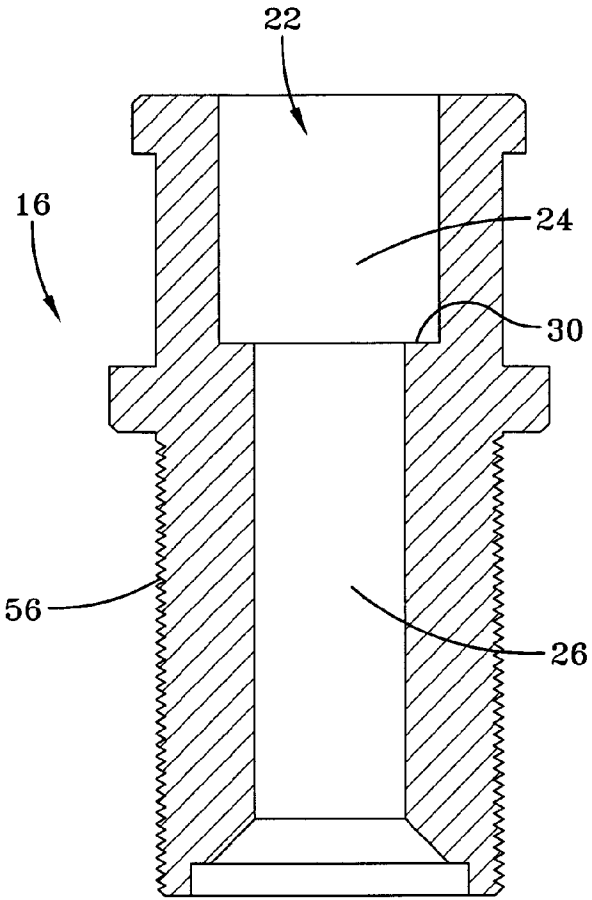
FIG. 6 is a sectional side view of a housing.
Figure 5:
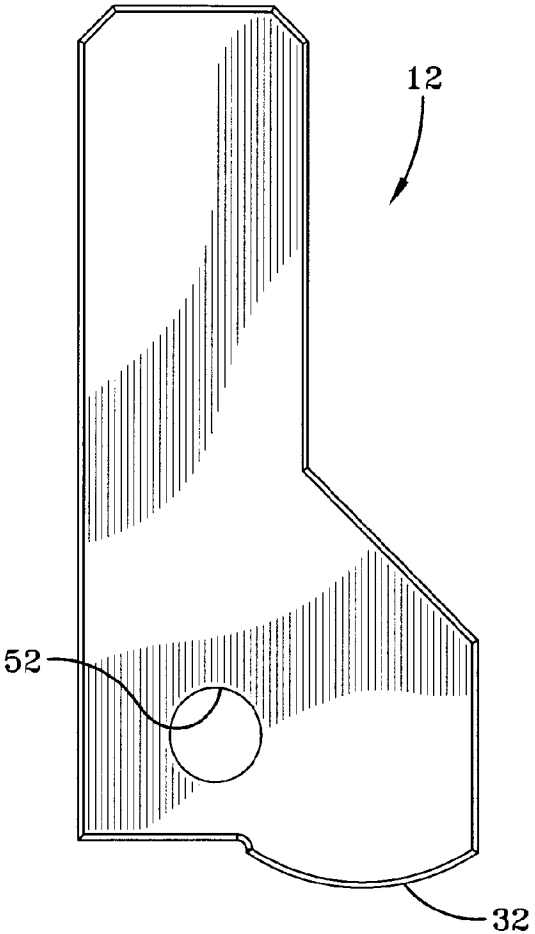
FIG. 5 is a side view of a lever arm.

FIG. 3 is a side view of an embodiment of the shoe 18 that fits in housing 16. An upper portion 46 of the shoe 18 is preferably externally threaded to engage the internal bore 50 of shoe cap 28 (FIG. 4). The shoe bottom 48 contacts mortar bomb 36 when the shoe 18 is extended. FIG. 4 is a sectional side view of an embodiment of the shoe cap 28. Shoe cap 28 includes an internally threaded bore 50 that mates with upper threaded portion 46 of shoe 18. FIG. 5 is a side view of an embodiment of lever arm 12. Lever arm 12 includes a hole 52 for receiving pin 15. A bottom portion 32 of lever arm 12 contacts shoe cap 28. FIG. 6 is a sectional side view of an embodiment of housing 16. Central opening 22 in housing 16 includes a large diameter upper portion 24 and a small diameter lower portion 26. A step 30 is formed between the large and small diameter portions 24, 26. The lower external surface 56 of the housing 16 is preferably externally threaded to engage internal threads formed on the opening in the wall of the mortar tube 34.

Figure 7A:
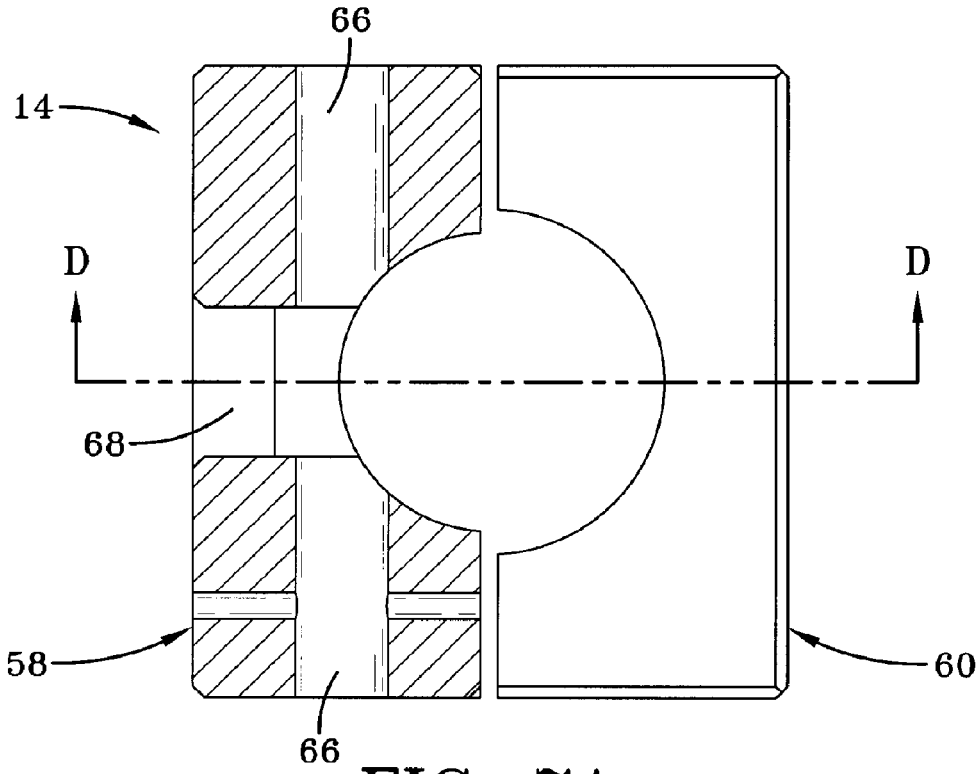
FIG. 7A is a sectional top view of a lever positioner taken along the line A—A of FIG. 7E.
Figure 7B:
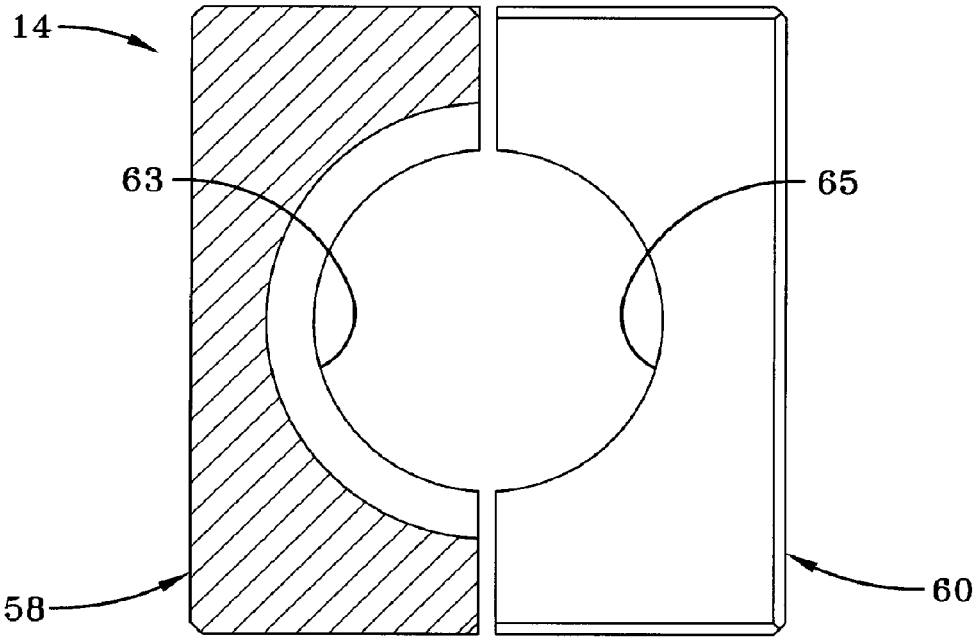
FIG. 7B is a sectional top view of the lever positioner taken along the line B—B of FIG. 7E.
Figure 7C:
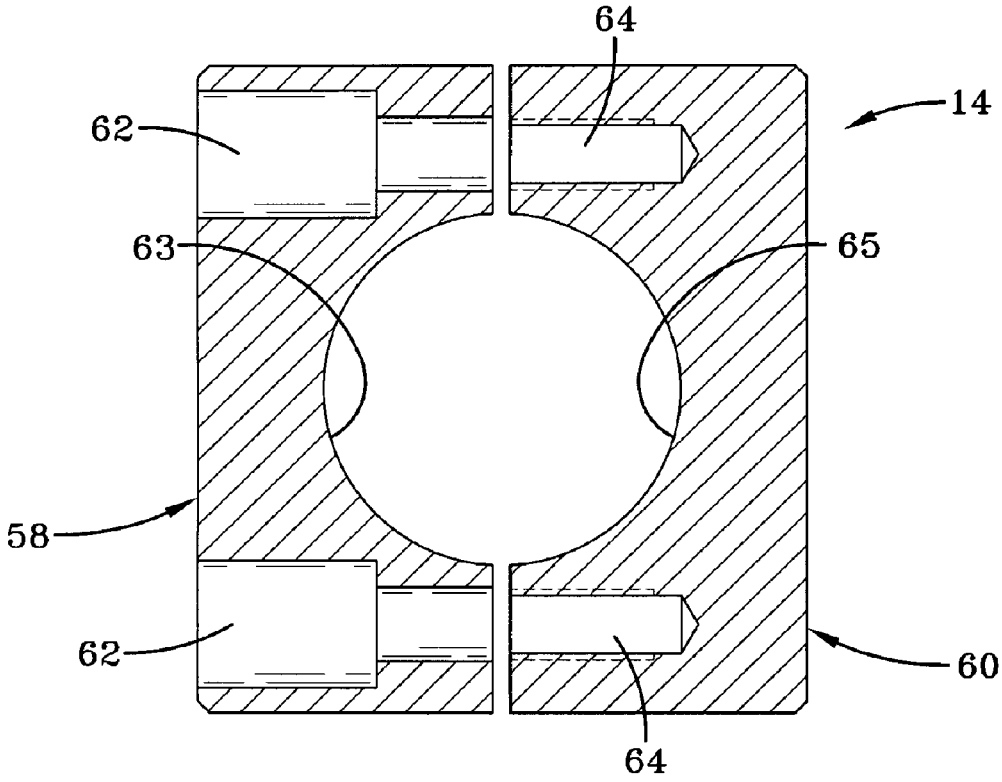
FIG. 7C is a sectional top view of the lever positioner taken along the line C—C of FIG. 7E.
Figure 7D:
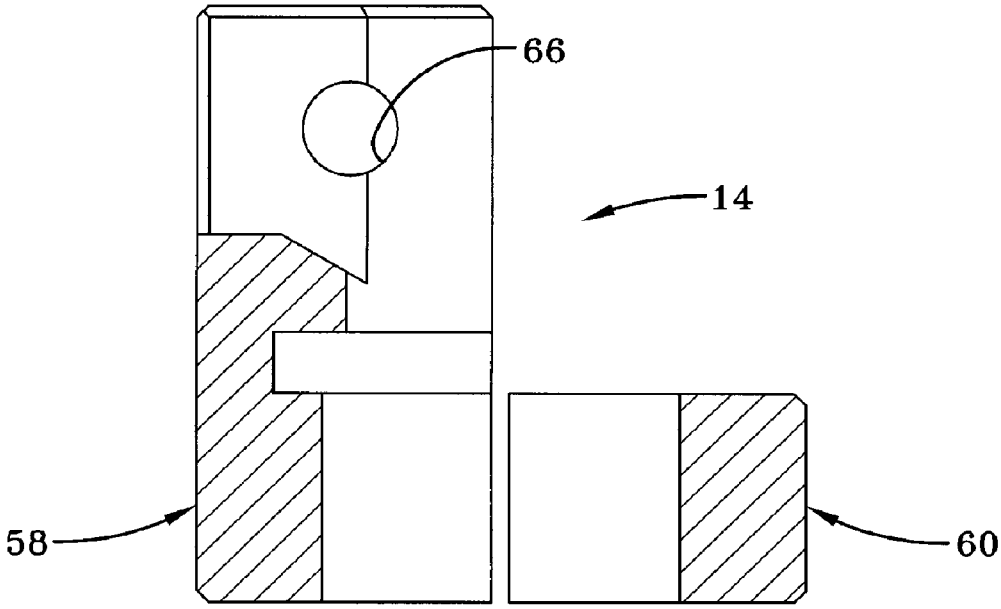
FIG. 7D is a sectional side view of the lever positioner taken along the line D—D of FIG. 7A.
Figure 7E:
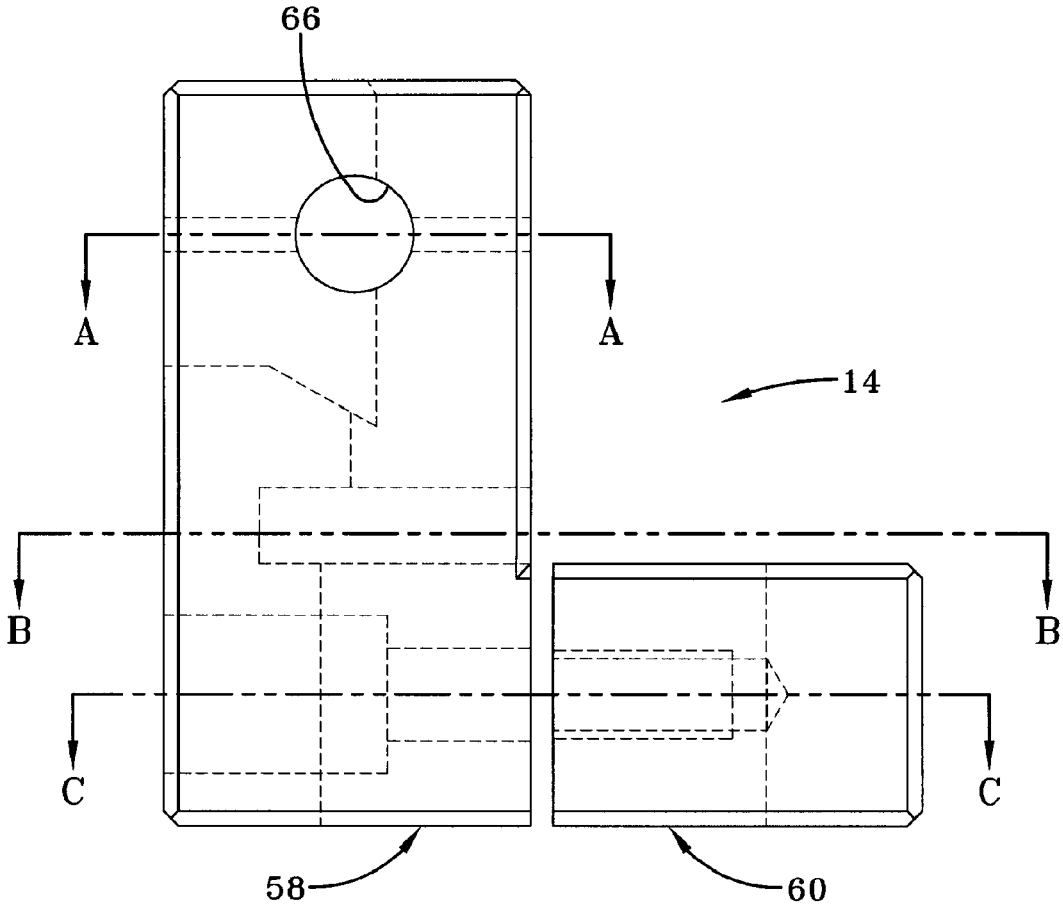
FIG. 7E is a side view of the lever positioner.

FIGS. 7A through 7E show different views of an embodiment of a lever positioner 14. Specifically, FIG. 7A is a sectional top view of the lever positioner 14 taken along the line A—A of FIG. 7E. FIG. 7B is a sectional top view of the lever positioner 14 taken along the line B—B of FIG. 7E. FIG. 7C is a sectional top view of the lever positioner 14 taken along the line C—C of FIG. 7E. FIG. 7D is a sectional side view of the lever positioner 14 taken along the line D—D of FIG. 7A. FIG. 7E is a side view of the lever positioner 14. Lever positioner 14 comprises first and second portions 58, 60. Each of first and second portions 58, 60 include semicircular openings 63, 65 in which housing 16 fits. First and second portions 58, 60 are clamped around housing 16 by inserting screws through holes 62 in first portion 58 and into threaded holes 64 in second portion 60. First portion 58 includes a hole 66 in which pin 15 is inserted to support lever arm 12. The bottom of lever arm 12 is disposed in a channel 68 formed in first portion 58.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A mortar bomb retention apparatus for retaining a mortar bomb in a mortar tube, comprising:

a lever arm;

a lever positioner in which the lever arm is rotatably mounted;

a generally cylindrical housing having a central opening therethrough, the central opening comprising a large diameter portion and a small diameter portion, the lever positioner being fixed to the housing;

a shoe disposed in the central opening in the housing;

a compression spring disposed around the shoe in the large diameter portion of the central opening; and a shoe cap attached to an end of the shoe, one end of the compression spring bearing against the shoe cap, a portion of the lever arm contacting the shoe cap wherein rotation of the lever arm is operable to force the shoe downward.

2. The apparatus of claim 1 further comprising a solenoid having a plunger wherein the plunger is operable to rotate the lever arm.

3. The apparatus of claim 1 wherein the mortar tube includes an opening through which the shoe contacts the mortar bomb, the housing being fixed to the mortar tube in the opening.

4. The apparatus of claim 1 wherein the central opening includes a step located between the large and small diameter portions, another end of the compression spring bearing against the step.

5. The apparatus of claim 1 further comprising a fire control computer electrically connected to the solenoid.

6. In a mortar munition having a recoilless surface, a mortar tube and a mortar bomb; a mortar bomb retention apparatus, comprising:

a lever arm;

a lever positioner in which the lever arm is rotatably mounted;

a generally cylindrical housing having a central opening therethrough, the central opening comprising a large diameter portion and a small diameter portion, the lever positioner being fixed to the housing;

a shoe disposed in the central opening in the housing;

a compression spring disposed around the shoe in the large diameter portion of the central opening;

a shoe cap attached to an end of the shoe, one end of the compression spring bearing against the shoe cap, a portion of the lever arm contacting the shoe cap wherein rotation of the lever arm is operable to force the shoe downward; and a solenoid mounted to the recoilless surface, the solenoid having a plunger that is operable to rotate the lever arm.

7. The apparatus of claim 6 wherein the mortar tube includes an opening through which the shoe contacts the mortar bomb, the housing being fixed to the mortar tube in the opening.

8. The apparatus of claim 6 wherein the central opening includes a step located between the large and small diameter portions, another end of the compression spring bearing against the step.

9. The apparatus of claim 6 further comprising a fire control computer electrically connected to the solenoid.

10. A mortar munition, comprising:

a recoilless surface;

a mortar tube;

a mortar bomb disposed in the mortar tube;

a solenoid mounted to the recoilless surface, the solenoid having a plunger;

a lever arm;

a lever positioner in which the lever arm is rotatably mounted;

a generally cylindrical housing having a central opening therethrough, the central opening comprising a large diameter portion and a small diameter portion, the lever positioner being fixed to the housing;

a shoe disposed in the central opening in the housing;

a compression spring disposed around the shoe in the large diameter portion of the central opening; and a shoe cap attached to an end of the shoe, one end of the compression spring bearing against the shoe cap, a portion of the lever arm contacting the shoe cap wherein rotation of the lever arm is operable to force the shoe downward and further wherein the solenoid plunger is operable to rotate the lever arm.

11. The munition of claim 10 wherein the mortar tube includes an opening through which the shoe contacts the mortar bomb, the housing being fixed to the mortar tube in the opening.

12. The munition of claim 10 wherein the central opening includes a step located between the large and small diameter portions, another end of the compression spring bearing against the step.

13. The munition of claim 10 further comprising a fire control computer electrically connected to the solenoid.

* * * * *